US011776768B2

(12) United States Patent
Strand

(10) Patent No.: US 11,776,768 B2
(45) Date of Patent: Oct. 3, 2023

(54) ELECTRICAL SWITCH

(71) Applicant: ABB Schweiz AG, Baden (CH)

(72) Inventor: Fredrik Strand, Vaasa (FI)

(73) Assignee: ABB Schweiz AG, Baden (CH)

( * ) Notice: Subject to any disclaimer, the term of this patent is extended or adjusted under 35 U.S.C. 154(b) by 0 days.

(21) Appl. No.: 17/804,489

(22) Filed: May 27, 2022

(65) Prior Publication Data

US 2022/0384120 A1 Dec. 1, 2022

(30) Foreign Application Priority Data

Jun. 1, 2021 (EP) ..... 21177117

(51) Int. Cl.
*H01H 1/14* (2006.01)
*H01H 9/02* (2006.01)

(52) U.S. Cl.
CPC ..... *H01H 1/14* (2013.01); *H01H 9/02* (2013.01); *H01H 2235/01* (2013.01)

(58) Field of Classification Search
CPC ..... H01H 1/14; H01H 9/02; H01H 2235/01; H01H 1/20; H01H 1/2016; H01H 1/34; H01H 3/32
USPC ..... 200/17 R, 18, 17 A, 238, 239, 243, 249, 200/251, 259, 261, 286, 287
See application file for complete search history.

(56) References Cited

U.S. PATENT DOCUMENTS 6,337,613 B1 * 1/2002 Grelier ..... H01H 71/121 361/93.6

FOREIGN PATENT DOCUMENTS

| | | | | |
|---|---|---|---|---|
| DE | 1690801 U | | 1/1955 | |
| DE | 1813181 U | * | 6/1960 | ..... H02B 1/48 |
| DE | 1813181 U | | 6/1960 | |
| EP | 3188206 A1 | | 7/2017 | |

OTHER PUBLICATIONS

European Search Report; Application No. EP 21 17 7117; dated Nov. 8, 2021; 2 Pages.

* cited by examiner

*Primary Examiner* — Edwin A. Leon
*Assistant Examiner* — Iman Malakooti
(74) *Attorney, Agent, or Firm* — WHITMYER IP GROUP LLC

(57) ABSTRACT

An electrical switch including a neutral contact adjustment system adapted for adjusting a position of a neutral contact opening surface relative to at least one phase contact opening surface such that the neutral contact adjustment system has a first operating state which is adapted to provide a simultaneous break operation in which a movable neutral contact disconnects simultaneously with at least one movable phase contact during an opening event, and a second operating state which is adapted to provide a late-break operation in which the movable neutral contact disconnects later than the at least one movable phase contact during the opening event.

16 Claims, 4 Drawing Sheets

ELECTRICAL SWITCH

TECHNICAL FIELD

The present invention relates to an electrical switch.

BACKGROUND

There are two types of electrical switches provided with a neutral pole. In an electrical switch with a simultaneous break mechanism, a neutral pole is adapted to disconnect simultaneously with phase poles during an opening event. In an electrical switch with a late-break mechanism, a neutral pole is adapted to disconnect later than phase poles during an opening event.

It is known in the art to manufacture an electrical switch with a simultaneous break mechanism and an electrical switch with a late-break mechanism such that they both are based on the same phase pole unit, and the type of the electrical switch depends on a type of a neutral pole unit connected to the phase pole unit. The electrical switch with the simultaneous break mechanism is provided by combining the phase pole unit with a neutral pole unit of a simultaneous break type, and the electrical switch with the late-break mechanism is provided by combining the phase pole unit with a neutral pole unit of a late-break type.

One of the disadvantages associated with the above known electrical switches is that it is necessary to manufacture and to keep in stock two different types of neutral pole units.

SUMMARY

An object of the present invention is to provide an electrical switch so as to alleviate the above disadvantage. The objects of the invention are achieved by an electrical switch which is characterized by what is stated in the independent claim. The preferred embodiments of the invention are disclosed in the dependent claims.

The invention is based on the idea of providing an electrical switch with a neutral contact adjustment system having a first operating state adapted to provide a simultaneous break operation, and a second operating state adapted to provide a late-break operation.

An advantage of the electrical switch of the invention is that one and the same electrical switch can be adjusted to operate as a simultaneous break switch or a late-break switch without adding or removing any components from the electrical switch.

In an embodiment, the type of the electrical switch can be changed between simultaneous break and late-break by rotating an operating head with a tool such as a screwdriver.

BRIEF DESCRIPTION OF THE DRAWINGS

In the following the invention will be described in greater detail by means of preferred embodiments with reference to the attached drawings, in which.

DETAILED DESCRIPTION OF THE INVENTION

Figure 1:
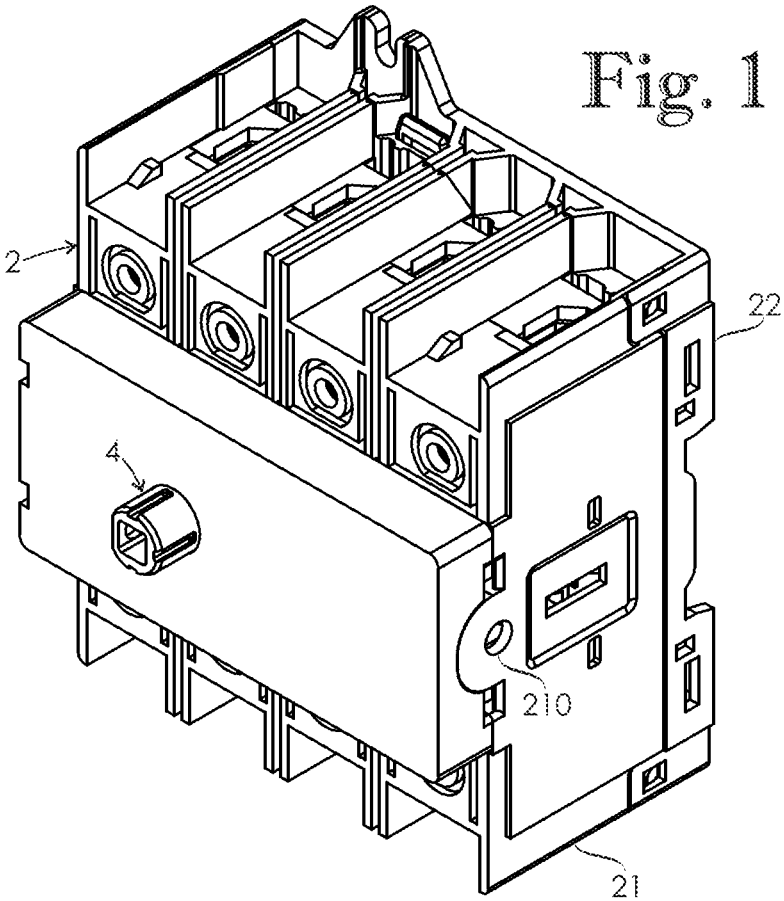
FIG. 1 shows an electrical switch according to an embodiment of the invention.
Figure 2:
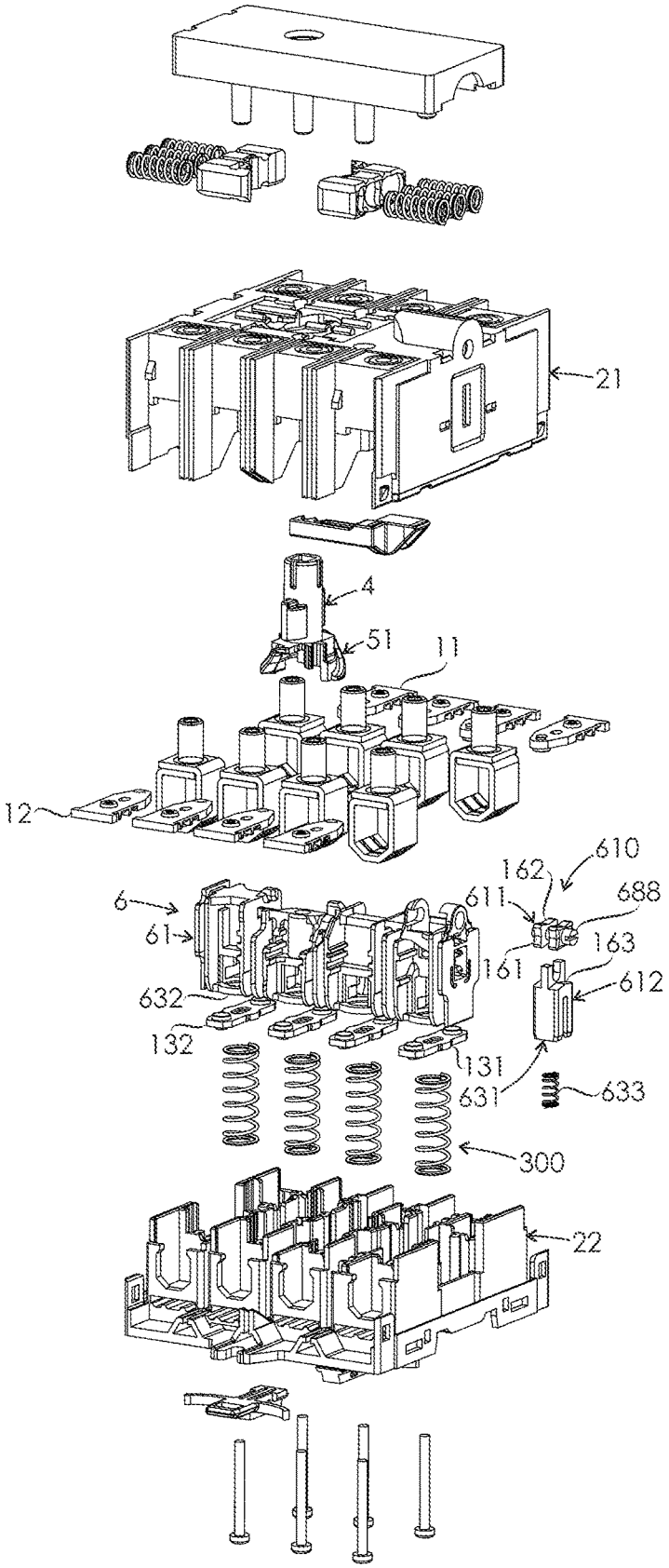
FIG. 2 shows an exploded view of the electrical switch shown in FIG. 1.

FIG. 1 shows an electrical switch, and FIG. 2 shows an exploded view thereof. The electrical switch comprises a frame 2, an operating mechanism, a bridge assembly 6, a movable contact system, a stationary contact system, a neutral contact adjustment system 610, and a return spring system 300.

The frame 2 comprises a first frame portion 21, and a second frame portion 22. A mechanism of the electrical switch is mounted in the frame 2.

The movable contact system has four movable contacts comprising a movable neutral contact 131, and three movable phase contacts 132. The movable contacts are electrically insulated from each other. Each of the movable contacts is movable relative to the frame 2 between a connected position and a disconnected position such that the connected position corresponds to a connected state of the electrical switch, and the disconnected position corresponds to a disconnected state of the electrical switch.

The stationary contact system has a stationary phase contact pair for each of the movable phase contacts 132, and a stationary neutral contact pair for the movable neutral contact 131. Each stationary phase contact pair and the stationary neutral contact pair comprises a first stationary contact 11 and a second stationary contact 12. The stationary contact system is stationary mounted relative to the frame 2.

In the connected state of the electrical switch, each stationary phase contact pair is electrically conductively connected by a corresponding movable phase contact 132, and the stationary neutral contact pair is electrically conductively connected by the movable neutral contact 131. In the disconnected state of the electrical switch, each stationary phase contact pair is electrically isolated, and the stationary neutral contact pair is electrically isolated.

The bridge assembly 6 comprises a bridge body 61, a neutral contact opening surface 631, and a phase contact opening surface 632 for each of the movable phase contacts 132. The bridge assembly 6 is movable in a depth direction relative to the frame 2 between a first bridge position and a second bridge position by means of the operating mechanism. In the connected state of the electrical switch, the bridge assembly 6 is in the first bridge position, and in the disconnected state of the electrical switch, the bridge assembly 6 is in the second bridge position.

During an opening event, in which the electrical switch transfers from the connected state to the disconnected state, the bridge assembly 6 moves from the first bridge position to the second bridge position, the neutral contact opening surface 631 is in contact with the movable neutral contact 131 for moving the movable neutral contact 131 from the connected position to the disconnected position, and each phase contact opening surface 632 is in contact with a corresponding movable phase contact 132 for moving the movable phase contact 132 from the connected position to the disconnected position.

The operating mechanism has a first operating position and a second operating position such that moving of the operating mechanism from the first operating position to the second operating position is adapted to provide the opening event. The operating mechanism comprises an operating shaft 4 rotatable relative to the frame 2 such that a first shaft position of the operating shaft 4 corresponds to the first operating position of the operating mechanism, and a second shaft position of the operating shaft 4 corresponds to the second operating position of the operating mechanism. A rotation axis of the operating shaft 4 is parallel with the depth direction. The operating shaft 4 is adapted to remain stationary in the depth direction during a rotation between the first shaft position and the second shaft position.

During the opening event, the operating shaft 4 is adapted to exert a first opening force to the bridge assembly 6 for moving the bridge assembly 6 from the first bridge position to the second bridge position. The operating shaft 4 comprises a first screw thread surface 51, and the bridge body 61 comprises a second screw thread surface adapted to co-operate with the first screw thread surface 51 during the opening event such that said co-operation provides the first opening force.

The bridge body 61 is made of electrically insulating material. The phase contact opening surfaces 632 are stationary relative to the bridge body 61. The phase contact opening surfaces 632 are integral parts of the bridge body 61.

The neutral contact adjustment system 610 is adapted for adjusting a position of the neutral contact opening surface 631 relative to the phase contact opening surfaces 632. Therefore, the neutral contact adjustment system 610 is also adapted for adjusting a position of the neutral contact opening surface 631 relative to the bridge body 61.

The neutral contact adjustment system 610 has a first operating state and a second operating state. The first operating state is adapted to provide a simultaneous break operation in which the movable neutral contact 131 disconnects simultaneously with the movable phase contacts 132 during the opening event. The second operating state is adapted to provide a late-break operation in which the movable neutral contact 131 disconnects later than the movable phase contacts 132 during the opening event.

Figure 7:
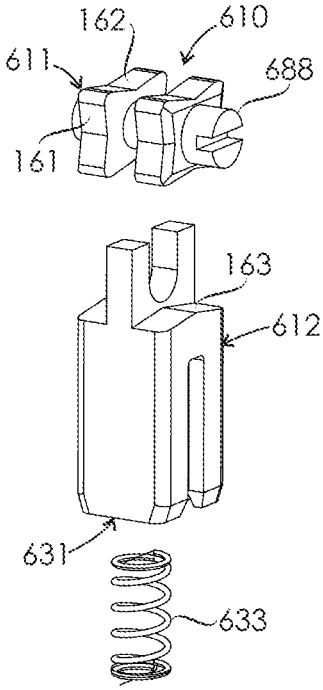
FIG. 7 shows the neutral contact adjustment system of the electrical switch shown in FIG. 1.
Figure 3A:
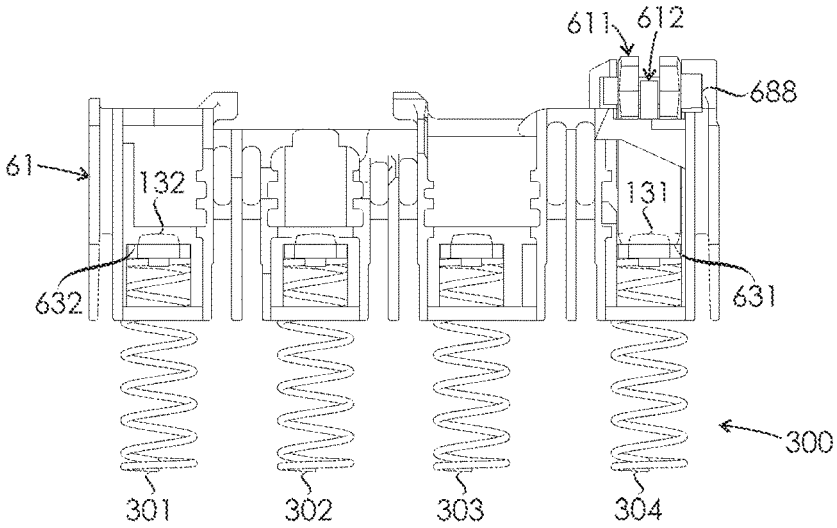
FIGS. 3A-3C show a portion of a mechanism of the electrical switch shown in FIG. 1 from different directions, wherein a neutral contact adjustment system is in a first operating state which is adapted to provide a simultaneous break operation.
Figure 3B:
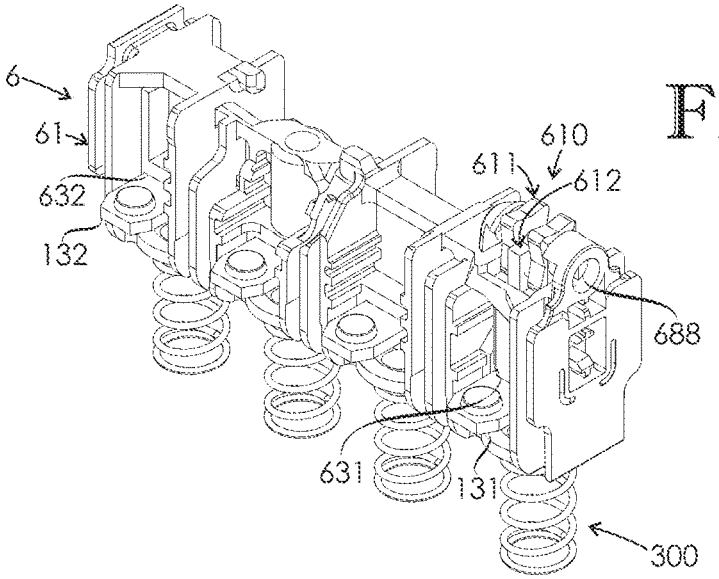
Figure 3C:
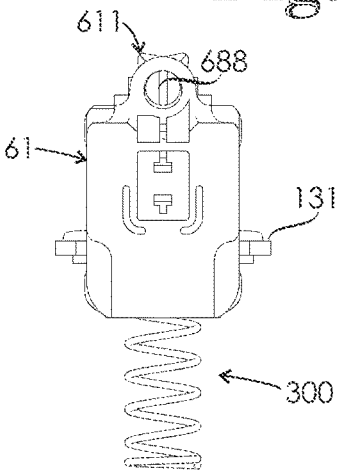
Figure 4:
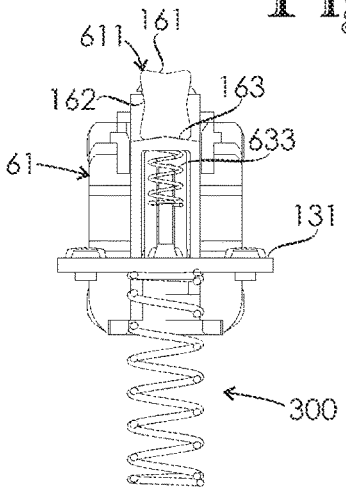
FIG. 4 shows the portion of the mechanism shown in FIG. 3C in cross section.
Figure 5A:
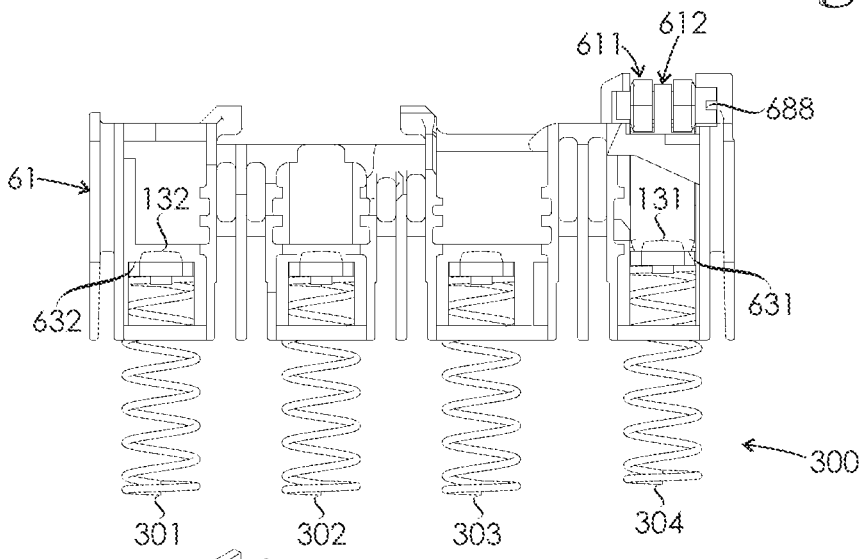
FIGS. 5A-5C show the portion of the mechanism of the electrical switch shown in FIG. 1 from different directions, wherein the neutral contact adjustment system is in a second operating state which is adapted to provide a late-break operation.
Figure 5B:
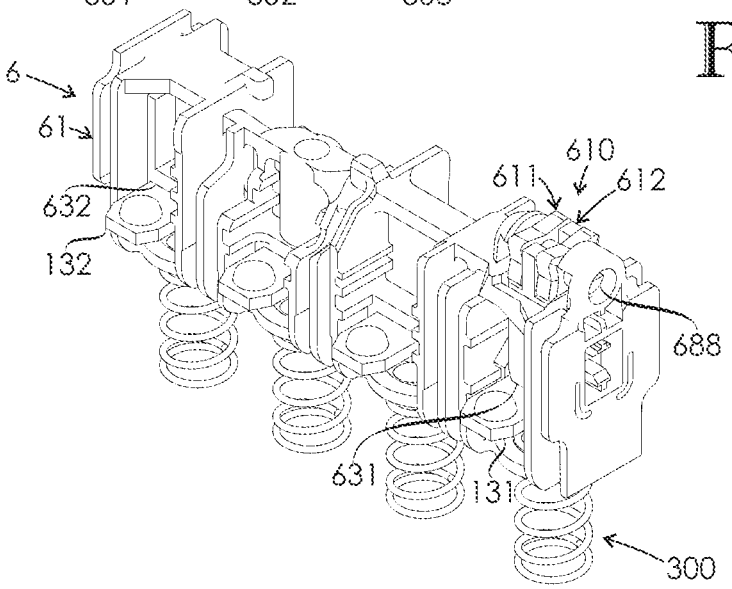
Figure 5C:
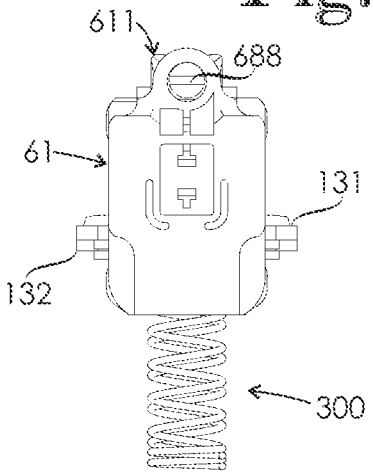
Figure 6:
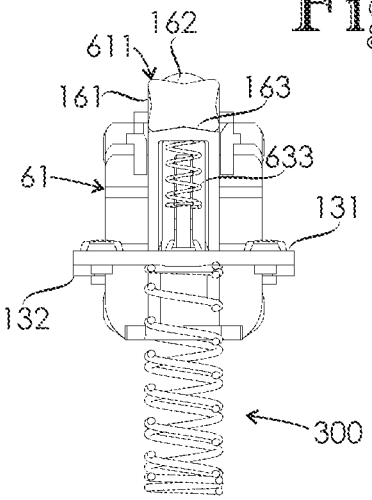
FIG. 6 shows the portion of the mechanism shown in FIG. 5C in cross section.

FIGS. 3A-3C show a portion of the mechanism of the electrical switch shown in FIG. 1 from different directions, in a situation where the neutral contact adjustment system 610 is in the first operating state. FIG. 4 shows the portion of the mechanism shown in FIG. 3C in cross section. FIGS. 5A-5C show the portion of the mechanism of the electrical switch shown in FIG. 1 from different directions, in a situation where the neutral contact adjustment system 610 is in the second operating state. FIG. 6 shows the portion of the mechanism shown in FIG. 5C in cross section. FIG. 7 shows an enlargement of the neutral contact adjustment system 610.

The neutral contact adjustment system 610 comprises a first adjustment member 611, a second adjustment member 612, and a retaining spring 633. The first adjustment member 611 and the second adjustment member 612 are made of electrically insulating material. The retaining spring 633 is a coil spring.

The first adjustment member 611 is rotatable relative to the bridge body 61 between a simultaneous break position and a late-break position. An angle between the simultaneous break position and the late-break position is 90°. The second adjustment member 612 comprises the neutral contact opening surface 631, and is movable in the depth direction relative to the bridge body 61 between a simultaneous break location and a late-break location by rotation of the first adjustment member 611 between the simultaneous break position and the late-break position. The neutral contact opening surface 631 is an integral part of the second adjustment member 612.

The first adjustment member 611 is an eccentric member comprising a first contact surface 161 and a second contact surface 162 such that a distance between a rotation axis of the first adjustment member 611 and the first contact surface 161 is greater than a distance between the rotation axis of the first adjustment member 611 and the second contact surface 162. The rotation axis of the first adjustment member 611 is stationary relative to the bridge body 61 such that the first adjustment member 611 is only adapted to rotate relative to the bridge body 61.

The second adjustment member 612 comprises a counter surface 163 such that in the simultaneous break position of the first adjustment member the counter surface 163 is in contact with the first contact surface 161, and in the late-break position of the first adjustment member the counter surface 163 is in contact with the second contact surface 162. The counter surface 163 is an integral part of the second adjustment member 612.

The first contact surface 161 and the second contact surface 162 are shaped as recesses, and the counter surface 163 is shaped as a protrusion. As best seen in FIGS. 4, 6 and 7, the first adjustment member 611 comprises two first contact surfaces 161, and two second contact surfaces 162 such that a crosssection of the first adjustment member 611 on a plane perpendicular to the rotation axis thereof resembles slightly a butterfly or a four-leaved clover.

The retaining spring 633 exerts a first spring force to the bridge body 61 and a second spring force to the second adjustment member 612. The second spring force is pressing the second adjustment member 612 against the first adjustment member 611 in order to resist movement of the first adjustment member 611 between the simultaneous break position and the late-break position.

The first adjustment member 611 and the second adjustment member 612 are shaped such that the first adjustment member 611 has an intermediate position between the simultaneous break position and the late-break position such that in the intermediate position of the first adjustment member 611, the retaining spring 633 presses the second adjustment member 612 stronger against the first adjustment member 611 than in the simultaneous break position and in the late-break position. Therefore, the shapes of the first adjustment member 611 and the second adjustment member 612 are adapted to resist movement of the first adjustment member 611 between the simultaneous break position and the late-break position such that the first adjustment member 611 is not able to rotate from the simultaneous break position to the late-break position or from the late-break position to the simultaneous break position without an external force applied to the first adjustment member 611.

The first adjustment member 611 comprises an operating head 688 adapted for rotating the first adjustment member 611 between the simultaneous break position and the late-break position. The operating head 688 is adapted to be rotated with a screwdriver.

Figure 8:
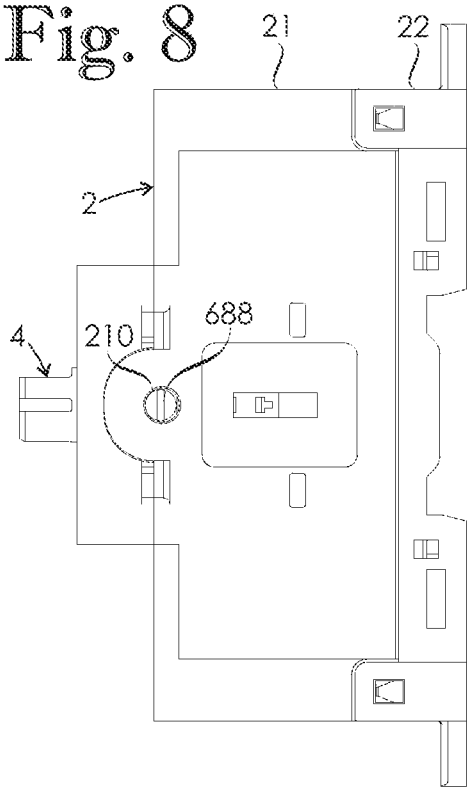
FIG. 8 shows a side view of the electrical switch shown in FIG. 1 in a connected state of the electrical switch.
Figure 9:
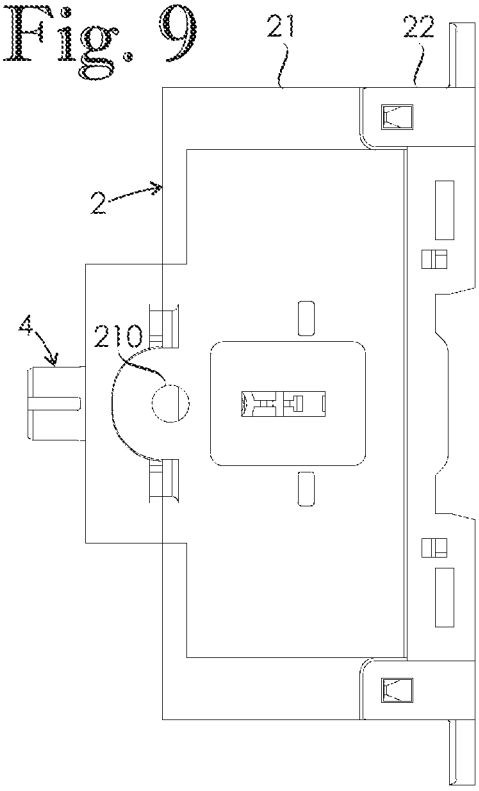
FIG. 9 shows a side view of the electrical switch shown in FIG. 1 in a disconnected state of the electrical switch.

FIG. 8 shows a side view of the electrical switch in the connected state, and FIG. 9 shows a side view of the electrical switch in the disconnected state. In FIGS. 8 and 9, the depth direction is a horizontal direction. FIGS. 8 and 9 show that the frame 2 is provided with an adjustment aperture 210 such that in the connected state of the electrical switch, the operating head 688 is accessible through the adjustment aperture 210, and in the disconnected state of the electrical switch the frame 2 blocks access to the operating head 688. In other words, the operating head 688 is accessible in the first bridge position, and inaccessible in the second bridge position.

The first adjustment member 611 is adapted to provide a visible position indication indicating whether the first adjustment member 611 is in the simultaneous break position or the late-break position. The operating head 688 has a slot head adapted to be driven by a flat-bladed screwdriver, and therefore a direction of the slot head indicates whether the first adjustment member 611 is in the simultaneous break position or in the late-break position.

The return spring system 300 is adapted to exert return forces to the movable contact system in order to return the movable neutral contact 131 and the movable phase contacts 132 to their connected positions if they are deflected therefrom in the direction of the disconnected positions thereof. The return spring system 300 comprises four return springs 301, 302, 303 and 304. Each of the return springs 301, 302 and 303 is in contact with a corresponding movable phase contact 132. The return spring 304 is in contact with the movable neutral contact 131.

It should be note that in FIGS. 3A-3C, 4, 5A—5C and 6, the return springs 301, 302, 303 and 304 are depicted in their resting position which means that the return springs are neither compressed nor extended. In a complete, operational electrical switch, the return springs 301, 302, 303 and 304 are slightly compressed in the connected state of the electrical switch, and more compressed in the disconnected state of the electrical switch. In other words, in a complete, operational electrical switch, the return springs 301-304 are tensioned also in the connected state of the electrical switch thereby pressing the movable contacts against corresponding stationary contacts.

The first stationary contacts 11 and the second stationary contacts 12 of the electrical switch are located on the same plane. In the connected state of the electrical switch, the movable neutral contact 131 and the movable phase contacts 132 are in contact with the first stationary contacts 11 and the second stationary contacts 12 such that there is a small gap between the neutral contact opening surface 631 and the movable neutral contact 131, and between each phase contact opening surface 632 and a corresponding movable phase contact 132.

In the connected state of the electrical switch, an operating state of the neutral contact adjustment system 610 affects a size of a gap between the neutral contact opening surface 631 and the movable neutral contact 131. In the second operating state of the neutral contact adjustment system 610 said gap is greater than in the first operating state. It is the larger gap that provides the late-break operation.

In the disconnected state of the electrical switch, the neutral contact opening surface 631 is in contact with the movable neutral contact 131, and each phase contact opening surface 632 is in contact with a corresponding movable phase contact 132 regardless of the operating state of the neutral contact adjustment system 610.

It will be obvious to a person skilled in the art that the inventive concept can be implemented in various ways. The invention and its embodiments are not limited to the examples described above but may vary within the scope of the claims.

The invention claimed is:

1. An electrical switch comprising:

a frame;

a movable contact system having a plurality of movable contacts comprising a movable neutral contact, and at least one movable phase contact, each of the movable contacts being movable relative to the frame between a connected position and a disconnected position;

a bridge assembly comprising a bridge body, a neutral contact opening surface, and a phase contact opening surface for each of the at least one movable phase contact, the bridge assembly being movable in a depth direction relative to the frame between a first bridge position and a second bridge position, wherein during an opening event, in which the electrical switch transfers from a connected state to a disconnected state, the bridge assembly moves from the first bridge position to the second bridge position, the neutral contact opening surface is in contact with the movable neutral contact for moving the movable neutral contact from the connected position to the disconnected position, and each phase contact opening surface is in contact with a corresponding movable phase contact for moving the movable phase contact from the connected position to the disconnected position, wherein the electrical switch comprises a neutral contact adjustment system adapted for adjusting a position of the neutral contact opening surface relative to the at least one phase contact opening surface such that the neutral contact adjustment system has a first operating state which is adapted to provide a simultaneous break operation in which the movable neutral contact disconnects simultaneously with the at least one movable phase contact during the opening event, and a second operating state which is adapted to provide a late-break operation in which the movable neutral contact disconnects later than the at least one movable phase contact during the opening event.

2. The electrical switch according to claim 1, wherein the neutral contact adjustment system comprises:

a first adjustment member rotatable relative to the bridge body between a simultaneous break position and a late-break position; and a second adjustment member comprising the neutral contact opening surface and movable in the depth direction relative to the bridge body between a simultaneous break location and a late-break location by rotation of the first adjustment member between the simultaneous break position and the late-break position.

3. The electrical switch according to claim 2, wherein the first adjustment member is an eccentric member comprising a first contact surface and a second contact surface such that a distance between a rotation axis of the first adjustment member is greater than a distance between the rotation axis of the first adjustment member and the second contact surface, and the second adjustment member comprises a counter surface such that in the simultaneous break position of the first adjustment member the counter surface is in contact with first contact surface, and in the late-break position of the first adjustment member the counter surface is in contact with second contact surface.

4. The electrical switch according to claim 2, wherein the neutral contact adjustment system comprises a retaining spring which exerts a first spring force to the bridge body and a second spring force to the second adjustment member wherein the second spring force is pressing the second adjustment member against the first adjustment member in order to resist movement of the first adjustment member between the simultaneous break position and the late-break position.

5. The electrical switch according to claim 4, wherein the first adjustment member and the second adjustment member are shaped such that the first adjustment member has an intermediate position between the simultaneous break position and the late-break position such that in the intermediate position of the first adjustment member, the retaining spring presses the second adjustment member stronger against the first adjustment member than in the simultaneous break position and in the late-break position.

6. The electrical switch according to claim 5, wherein the first contact surface and the second contact surface are shaped as recesses, and the counter surface is shaped as a protrusion.

7. The electrical switch according to claim 2, wherein an angle between the simultaneous break position and the late-break position is 90°.

8. The electrical switch according to claim 2, wherein the first adjustment member comprises an operating head adapted for rotating the first adjustment member between the simultaneous break position and the late-break position, the operating head being accessible in the first bridge position, and inaccessible in the second bridge position.

9. The electrical switch according to claim 8, wherein the frame is provided with an adjustment aperture such that in the first bridge position, the operating head is accessible through the adjustment aperture, and in the second bridge position the frame blocks access to the operating head.

10. The electrical switch according to claim 9, wherein in the first bridge position, the first adjustment member is adapted to provide a visible position indication indicating whether the first adjustment member is in the simultaneous break position or the late-break position.

11. The electrical switch according to claim 1, wherein the electrical switch comprises an operating mechanism having a first operating position and a second operating position such that moving of the operating mechanism from the first operating position to the second operating position is adapted to provide the opening event.

12. The electrical switch according to claim 11, wherein the operating mechanism comprises an operating shaft rotatable relative to the frame such that a first shaft position of the operating shaft corresponds to the first operating position, and a second shaft position of the operating shaft corresponds to the second operating position, wherein the operating shaft is adapted to exert a first opening force to the bridge assembly during the opening event.

13. The electrical switch according to claim 12, wherein the operating shaft comprises a first screw thread surface, and the bridge assembly comprises a second screw thread surface adapted to co-operate with the first screw thread surface during the opening event such that said co-operation provides the first opening force, wherein the depth direction is parallel with a rotation axis of the operating shaft, and the operating shaft is adapted to remain stationary in the depth direction during a rotation between the first shaft position and the second shaft position.

14. The electrical switch according to claim 1, wherein the electrical switch comprises a return spring system adapted to exert return forces to the movable contact system in order to return the movable neutral contact and the at least one movable phase contact to their connected positions if they are deflected therefrom in the direction of the disconnected positions thereof.

15. The electrical switch according to claim 1, wherein the electrical switch comprises a stationary contact system having a stationary phase contact pair for each of the at least one movable phase contact, and a stationary neutral contact pair for the movable neutral contact, the stationary contact system being stationary mounted relative to the frame-p, wherein in the connected state each stationary phase contact pair is electrically conductively connected by a corresponding movable phase contact, and the stationary neutral contact pair is electrically conductively connected by the movable neutral contact, and in the disconnected state each stationary phase contact pair is electrically isolated, and the stationary neutral contact pair is electrically isolated.

16. The electrical switch according to claim 3, wherein the neutral contact adjustment system comprises a retaining spring which exerts a first spring force to the bridge body and a second spring force to the second adjustment member, wherein the second spring force is pressing the second adjustment member against the first adjustment member in order to resist movement of the first adjustment member between the simultaneous break position and the late-break position.

* * * * *